US005207611A

United States Patent [19]

Ueda et al.

[11] Patent Number: 5,207,611

[45] Date of Patent: May 4, 1993

[54] COIN SORTING APPARATUS

[75] Inventors: Nobuo Ueda, Sakae; Tatsuo Okita, Itami; Mikio Suzuki, Waizumi; Yasunori Ikemoto; Hiroyuki Shibao, both of Osaka, all of Japan

[73] Assignee: Laurel Bank Machines Co., Ltd., Tokyo, Japan

[21] Appl. No.: 730,997

[22] Filed: Jul. 16, 1991

[30] Foreign Application Priority Data

Jul. 16, 1990 [JP] Japan ..... 2-187491

[51] Int. Cl.[5] ..... G07D 3/14

[52] U.S. Cl. ..... 453/011; 453/56

[58] Field of Search ..... 453/3, 4, 5, 7, 11, 453/56, 32; 194/317, 318, 319

[56] References Cited

U.S. PATENT DOCUMENTS 4,370,990 2/1983 Watanabe ..... 453/32
4,681,204 7/1987 Zimmermann ..... 194/317

FOREIGN PATENT DOCUMENTS

WO85/05478 12/1985 .
3204515 9/1982 Fed. Rep. of Germany .
53-83691 7/1978 Japan .
59-9787 1/1984 Japan .
1111636 5/1968 United Kingdom .
2054932 2/1981 United Kingdom .
87-07742 12/1987 World Int. Prop. O. ..... 453/7

*Primary Examiner*—F. J. Bartuska
*Attorney, Agent, or Firm*—Keck, Mahin & Cate

[57] ABSTRACT

The invention provides an apparatus for sorting various kinds of coins into various categories of coins. To this end, the invention includes a semicircular member having a plane surface and an arc surface. The semicircular member is capable of rotating between a first position wherein the plane surface is disposed substantially in the plane defined by a guiding edge and the arc surface is disposed within a guide rail and a second position wherein the plane surface is disposed normal to the guiding edge and the arc surface faces towards the upstream of the coin feeding direction. The semicircular member rotates from the first position to the second position when a first group coin is fed to collide with the semicircular member so as to diverge the coin away from the guiding edge so that the circumferential end of the coin closest to the guiding edge is disposed on a sort-out opening. The semicircular member returns to the first position when the coin passes the semicircular member.

12 Claims, 12 Drawing Sheets

COIN SORTING APPARATUS

FIELD OF THE INVENTION

The present invention relates to an apparatus for sorting coins which determines the different kinds of coins and the genuineness of the coins by detecting outer diameters and/or magnetic characteristics of coins so as to drop into an opening coins other than those which it is desired to pick up.

PRIOR ART

Two types of coin sorting apparatus are conventionally used. One sorts coins by measuring the outer diameters of coins,(for instance, in Japanese Patent Public Disclosure No. 53-83691); the other determines the different kinds of coins by means of a suitable examining means and thus controls a gate of an opening into which coins other than those which it is desired to pick up are dropped, to open or close the gate so as to sort coins (for instance, see Japanese Patent Public Disclosure No. 59-9787).

In an apparatus for sorting coins by measuring outer diameters of coins, coins are fed along one of upright walls formed on opposite sides of a path of the movement of the coins and outer diameters of coins are determined by measuring the lengths of coins in the horizontal direction from the upright wall. Accordingly, in this apparatus, coins are required to be fed so as to be in contact with one of the upright walls. Therefore, when coins differ only a little in their outer diameters thereof, for instance, where the difference in the outer diameter between the Japanese 100 yen coin and 5 yen coin is only 0.6 mm, this causes the incorrect sorting of the coins as the coins are fed slightly apart from the upright wall.

In addition, in this apparatus, coins have to be sorted in an order from the largest to the smallest coin diameter or in converse way, which is inconvenient.

On the other hand, in the apparatus for sorting coins by controlling a gate to open or close it, as long as the gate is appropriately controlled to open or close it, coins are correctly sorted without fail. Accordingly, this apparatus is capable of sorting coins more exactly than the aforementioned apparatus for measuring the outer diameters of coins. Furthermore, this apparatus can sort coins conveniently in any order the operator desires with respect to the outer diameters of coins. However, since this apparatus operates a gate to sort the coins, exact timing of the opening or closing of the gate is required to avoid jamming and sorting coins incorrectly. For this end, it is necessary to feed coins with a predetermined separation therebetween in order to operate the gate appropriately. Accordingly, this apparatus has a problem in that the feeding speed cannot be increased over a specific speed.

SUMMARY OF THE INVENTION

It is therefore the object of the invention to provide a coin sorting apparatus which is capable of accurately sorting coins with higher feeding speed than the conventional apparatuses.

According to the present invention, the above and other objects can be accomplished by a coin sorting apparatus comprising: coin sending out means for receiving a plurality of various kinds of coins and sending out the coins one by one therefrom; a coin guideway extending from the coin sending out means; a guiderail having a guiding edge extending in the direction along which the coins are fed and disposed normal to the guideway; a coin feeding belt for pressing the coins sent out from the coin sending out means against the guideway to feed the coins with a portion thereof kept in contact with the guiding edge; coin identifying means for grouping the coins fed by the feeding belt into first and second groups in accordance with the face values of the coins; separating means having a sort-out opening disposed on the guideway apart from the guiding edge and extending in the coin feeding direction, said means separating the coins into the first and the second groups by dropping the coins belonging to the first group into the sort-out opening and feeding the coins belonging to the second group by the feeding belt, said second group coins straddling over the sort-out opening when being fed, in accordance with the determination by the coin identifying means, said coin sorting apparatus characterized by a semicircular member having a plane surface and an arc surface, said semicircular member capable of rotating between a first position wherein said plane surface is disposed substantially in the plane defined by the guiding edge and the arc surface is disposed within the guide rail and a second position wherein said plane surface is disposed normal to the guiding edge and said arc surface faces upstream of the coin feeding direction, said semicircular member rotating from the first position to the second position when the first group coin is fed to collide with the semicircular portion so as to diverge the coin away from the guiding edge so that the circumferential end of the coin closest to the guiding edge is disposed on the sort out opening, said semicircular member returning to the first position when the coin passes the semicircular member, said sort-out opening arranged so that the sum length of the length measured from the guiding edge to an edge of the sort-out opening closer to the sort-out opening and the width of the sort-out opening is smaller than the smallest diameter among the coins to be sorted by the coin sorting apparatus.

In the coin sorting apparatus in accordance with the invention, coins sent out from the coin sending out device are fed by the coin feeding belt with a circumferential end thereof kept in contact with the guiding edge. Then, the coins are identified as belonging to a first group or a second group depending on the face value thereof by the coin identifying device. Then, the coins are fed towards the diversion element.

When the coin identified as belonging to the first group by the coin identifying device are fed to the diversion device, the diversion device rotates from the first position to the second position to collide with the coin. Due to this collision, the first group coin is diverged away from the guiding edge. Due to the diversion, the first group coin ceases being in contact with the guiding edge and is forced to move away from the guiding edge. Then the first group coin reaches the sort-out opening formed on the coin guideway. When a circumferential end of the coin reaches the sort-out opening, the coin cannot be supported on the coin guideway and falls into the sort-out opening. After the first group coin has passed the diversion element, the element returns from the second position to the first position.

Even when the coin identified as belonging to the second group by the coin identifying device is fed to the diversion element, the element stays in its first position, so that the second group coin is fed without colliding with the diversion element, a circumferential end of the coin being kept in contact with the guiding edge. Since the sum length of the length measured from the guiding edge to one of the edges of the sort-out opening disposed closer to the guiding edge and the width of the sort-out opening is smaller than the smallest diameter among the coins to be sorted by the coin sorting apparatus, the second group coins are fed downstream by the feeding belt without falling into the sort-out opening, and then introduced into the coin reservoir.

The above and other objects and advantageous features of the present invention will become apparent from the following description made with reference to the accompanying drawings.

DESCRIPTION OF PREFERRED EMBODIMENTS

Figure 1:
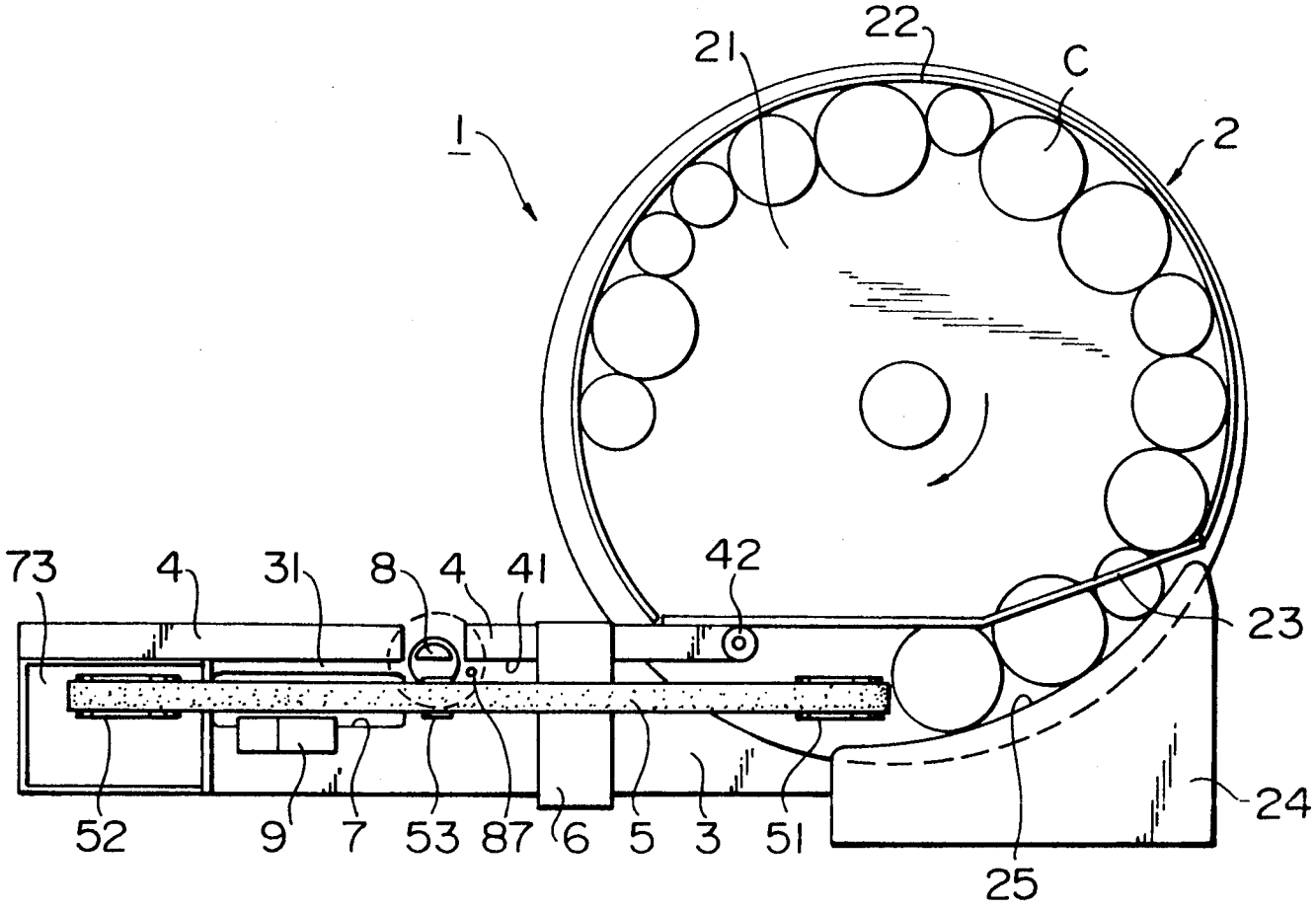
FIG. 1 is a top plan view of a coin sorting apparatus in accordance with the invention.
Figure 2:
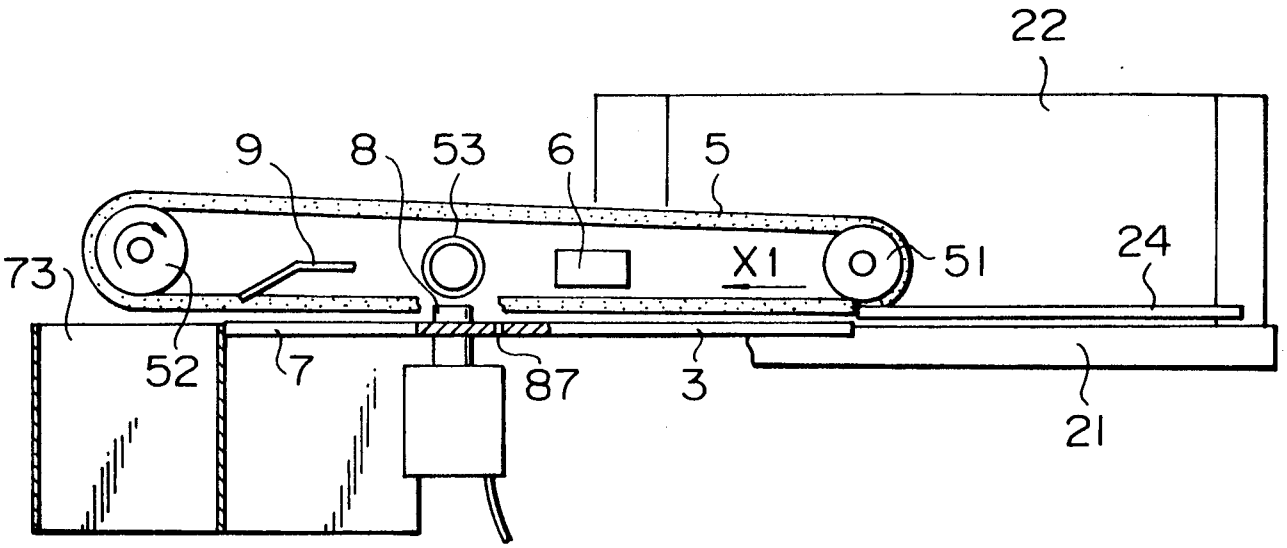
FIG. 2 is a side elevational view of the coin sorting apparatus shown in FIG. 1.

Referring to FIGS. 1 and 2, a coin sorting apparatus 1 comprises a coin sending out device 2, a coin guideway 3, a guide rail 4, a coin feeding belt 5, a coin identifying device 6, a sort-out opening 7, a diversion device 8 for changing a coin feeding direction and a guide member 9 for guiding coins so that they will be dropped into the sort-out opening 7.

The coin sending out device 2 comprises a rotary disc 21 capable of rotating in a clockwise direction and a side wall 22 circumferentially standing on the rotary disc 21 and supported by a suitable support (not shown). A bridge member 23 is provided to be continuous with the side wall 22 for forming a gap between the disc 21 and a lower edge of the member, which gap is slightly larger than the thickness of a coin having the largest thickness among coins to be received on the rotary disc 21. A guide block 24, which has an arc-shaped surface 25 which is continuous with the circumferential side wall 22, is provided circumferentially on the disc 21.

The coin guideway 3 is formed at the same elevation as the rotary disc 21 and to be continuous with the rotary disc 21. Coins are sent out from the rotary disc 21 into the coin guideway 3.

The guide rail 4 and the coin feeding belt 5 are provided on and above the coin guideway 3 respectively. The guide rail 4 has a guiding edge 41 disposed normal to the guideway 3 and extending in the direction along which coins are fed. As will be described later, coins are fed along the guiding edge 41 with a circumferential end of each coin being kept in contact with the guiding edge 41. A guide roller 42 is rotatably attached to one end of the guide rail 4, an axis around which the roller 42 rotates being disposed normal to the coin guideway 3 so that the roller 42 is disposed downstream from the end of the guide block 24 in the coin feeding direction and a bottom surface of the roller 42 almost comes in contact with the disc 21. The coin feeding belt 5 is wound around rollers 51 and 52 to be driven toward the direction indicated by an arrow X1. The coin feeding belt 5 compresses a coin sent out from the rotary disc 21 against the coin guideway 3, a circumferential end of the coin being kept in contact with the guiding edge 41 to feed the coin along the direction X1.

The coin identifying device 6 disposed within a loop of the belt 5 detects outer diameters and/or metalic characteristics of coins to determine whether the coin fed by the belt 5 is one which should be picked up, for instance a Japanese 100 yen coin, or one which should not be picked up, for instance, a Japanese 1 yen, 5 yen, 10 yen, 50 yen or 500 yen coin. (It should be noted that Japanese hard currency includes six kinds of coins: the 1 yen, 5 yen, 10 yen, 50 yen, 100 yen and 500 yen coins.) Then, the coin identifying device 6 emitts a signal in accordance with the determination made. More particularly, when the coin fed by the belt 5 is one which should be picked up, which is called hereinafter "a designated coin", the device 6 emits a signal S1, while when the coin fed by the belt 5 is one which should not be picked up, which is called hereinafter "an undesignated coin", the device 6 emits a signal S2. The signals S1 and S2 are transmitted to a controller 88, as will be described later with reference to FIG. 4.

Figure 3:
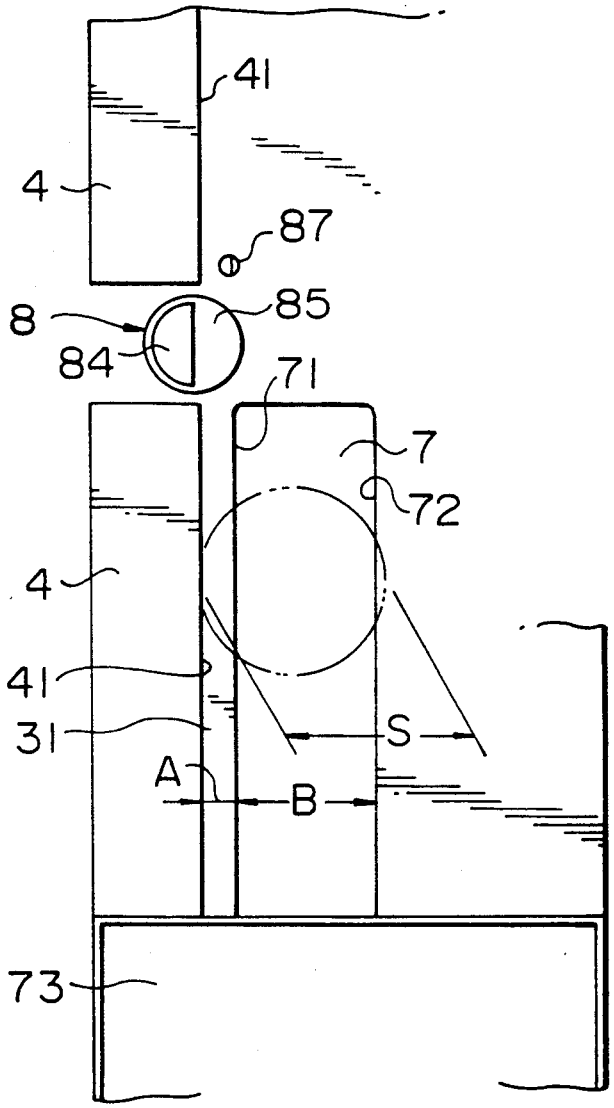
FIG. 3 is a top plan view of a diversion device and an arrangement therearound.

The sort-out opening 7 comprises a substantial rectangular opening extending along the coin feeding direction and is disposed downstream from the coin identifying device 6 on the coin guideway 3. As shown in FIG. 3, the sum of a width A of a portion 31 of the guideway 3 and a width B of the sort-out opening 7, in which the width A is the width between the guiding edge 41 and an edge 71 of the sort-out opening 7, is smaller than the smallest diameter S of a coin among the coins to be sorted by the coin sorting apparatus 1. That is, the following equation is formulated.

$$A+B<S$$

When the designated coins are fed straddling over the sort-out opening 7, an end portion of the coin is necessary to be disposed on the guideway portion 31, accordingly the width A of the guideway portion 31 is determined so that it has enough value to be able to feed coins over the sort-out opening 7. In addition, the width B of the sort-out opening is preferably determined to have a value as large as possible after the width A was determined.

A coin reservoir 73 is disposed downstream in the coin feeding direction from the sort-out opening 7 and has the substantially same opening width as the coin guideway 3. The designated coins are to be introduced into the reservoir 73.

Figure 4:
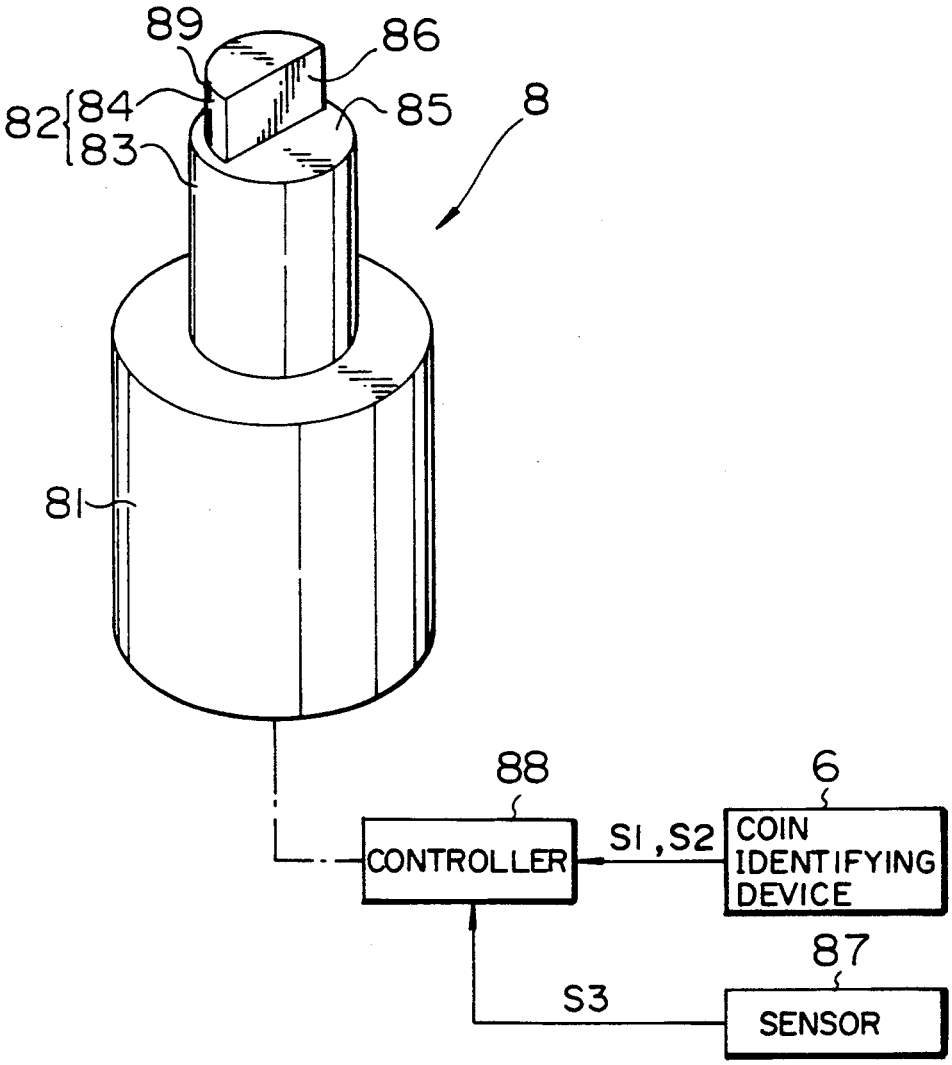
FIG. 4 is a schematic view of the diversion device and the connection thereof with other elements.

The guide rail 4 is partially divided to form a space between the coin identifying device 6 and the sort-out opening 7. The diversion device 8 is disposed in the space. As shown in FIG. 4, the diversion device 8 includes a rotary solenoid 81 capable of rotating in opposite directions and a shaft 82 attached to the rotary solenoid 81. The shaft 82 comprises a cylindrical portion 83 and a semicircular poriton 84 formed on the end surface of the cylindrical portion 82 and having a slightly smaller diameter than the cylindrical portion 83. The semicircular portion 84 includes a plane surface 86 and an arc surface 89. The rotary solenoid 81 rotates by 90 degrees in the clockwise direction and then stops when it is provided with a plus signal, on the other hand, it rotates by 90 degrees in the counterclockwise direction and then stops when it is provided with a minus signal. It should be noted that a stepping motor, which is able to be controlled on rotating directions and rotating degrees, may be used in place of the rotary solenoid 81. The controller 88 connects with the rotarty solenoid 81 to control the solenoid 81 with respect to the rotating direction in accordance with the signals S1 or S2 transmitted from the coin identifying device 6. The diversion device 8 is embedded in the guideway 3 so that a top surface 85 of the cylindrical portion 83 is disposed at the same elevation as the guideway 3. Accordingly, only the semicircular portion 84 projects above the coin guideway 3.

Figure 5A:
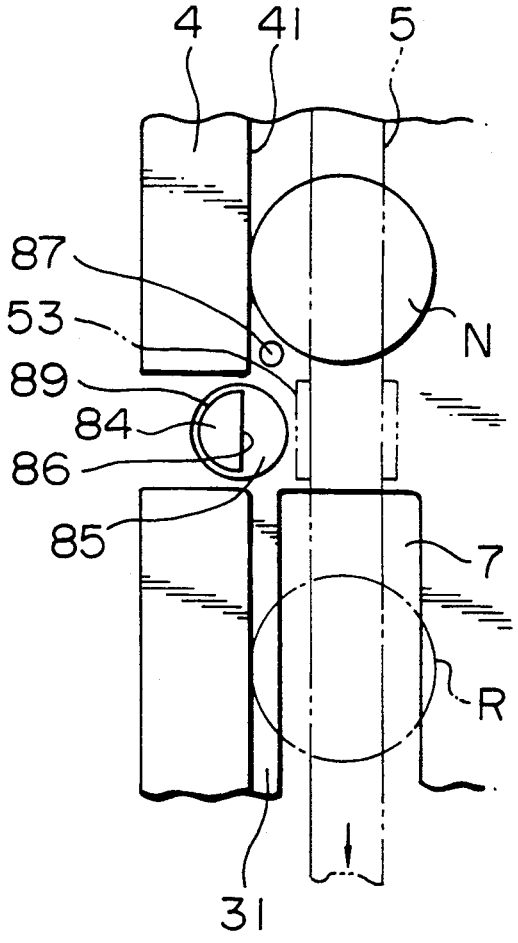
FIGS. 5A to 5D are top plan views illustrating coins having a feeding direction thereof changed by the diversion device.
Figure 5B:
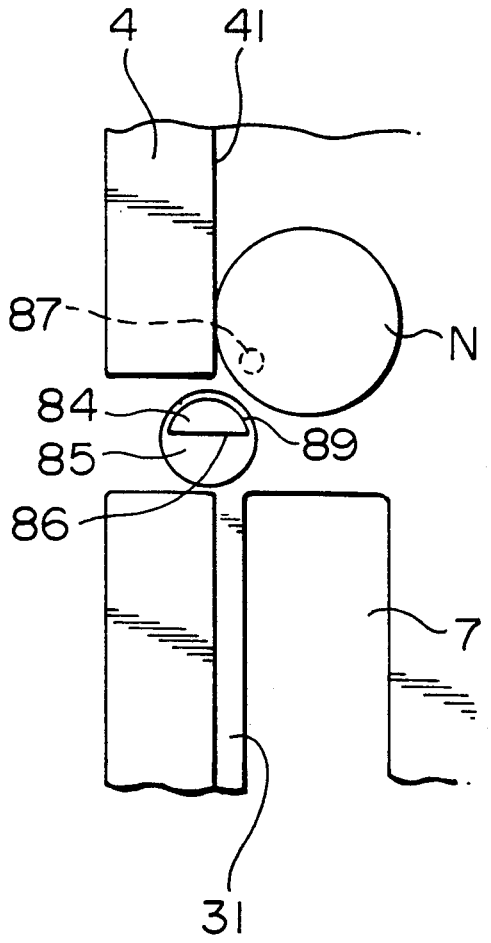

The shaft 82 is capable of rotating between an inactive or first position as shown in FIG. 5A and an active or second position as shown in FIG. 5B. In the first position, a plane surface 86 of the semicircular portion 84 substantially aligns with the guiding edge 41. The shaft 82 rotates in the clockwise direction in view of FIG. 5A from the first position to the second position. In the second position, almost half of the semicircular portion 84 projects into the guideway 3. In other words, the shaft 82 is embedded in the guideway 3 so that the center of the top surface 85 of the cylindrical portion 83 is disposed in alignment with the guiding edge 41.

The length by which the semicircular portion 84 projects into the guideway 3 when the diversion device 8 is disposed in the second position is determined so that the following equation formulates. Here 't' is displacement of a coin measuring from the guiding edge 41 when the coin fed from the coin sending out device 2 diverges to the direction indicated by an arrow X2, as shown in FIG. 5C, due to the collision with the semicircular portion 84 disposed in the second position.

$$A+B>>t>A$$

Figure 5C:
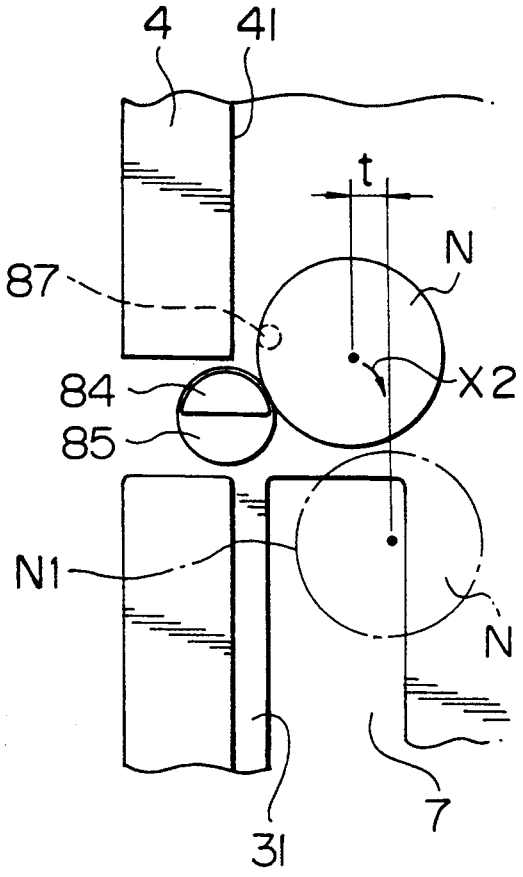

The projecting length of the semicircular portion 84 is determined in aforementioned manner so that the end N1 of the coin is diverged onto the sort-out opening 7 after the coin collided with the semicircular portion 84 disposed in its active position, as shown in FIG. 5C.

A coin detecting sensor 87 is embedded in the guideway 3 upstream from the diversion device 8. This sensor 87 is provided for detecting coins fed along the guiding edge 41. When the sensor 87 is covered with a coin fed, it transmitts a signal S3 to the controller 88.

A press roller 53 is provided almost in front of the diversion device 8 for pressing the coin feeding belt 5 against the guideway 3 to assure that coins are pressed against the guideway 3 near the diversion device 8.

Figure 6:
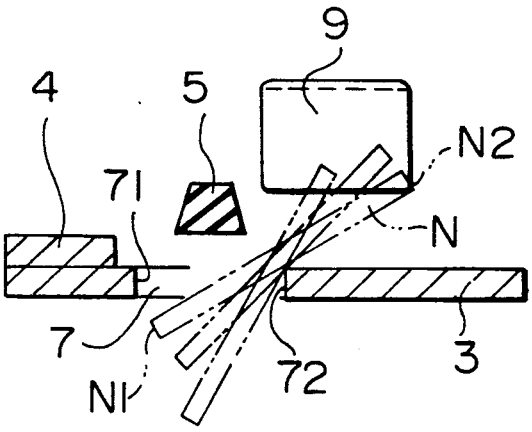
FIG. 6 is a schematic view illustrating a coin which hits with a guide member for introducing coins into a sort-out opening.
Figure 7:
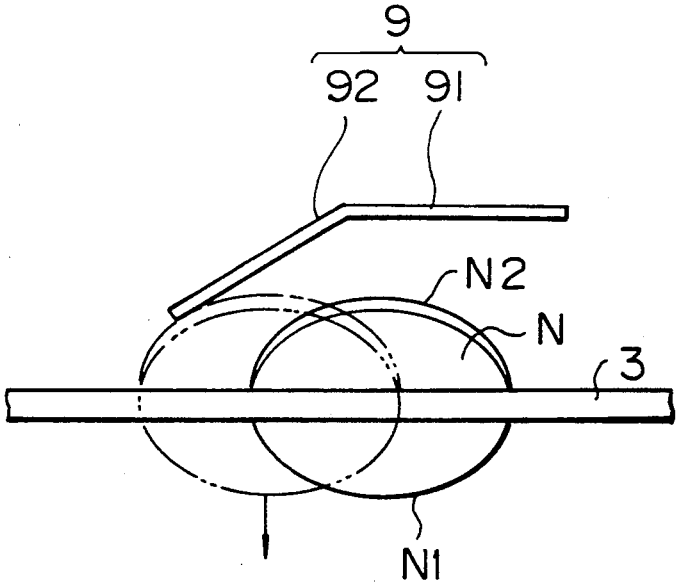
FIG. 7 is a schematic side view of FIG. 6.

As shown in FIG. 6, a guide member 9 is disposed above an edge 72 of the sort-out opening 7. As shown in FIG. 7, the guide member 9 comprises a substantially horizontal portion 91 parallel to the guideway 3 and a slant portion 92 sloping downward toward the downstream of the coin feeding direction.

The mode of operation of the aforementioned coin sorting apparatus 1 will be described hereinbelow.

A plurality of coins C including various kinds of coins are provided on the rotary disc 21. The coins C are rotated in the clockwise direction together with the rotary disc 21. The coins are kept in contact with the side wall 22 while rotating due to the centrifugal force derived from the rotation of the disc 21 and pass the gap formed between the rotary disc 21 and the lower edge of the bridge member 23 to avoid overlapping of coins. Then, the coins C are moved along the arc-shaped surface 25 of the guide block 24 and are pressed by the coin feeding belt 5 to start being fed. The coins collide with the rotatable guide roller 42 and thereby receive the reaction to contact the guiding edge 41 of the guide rail 4. Then, the coins starts being fed in contact with and along the guiding edge 41. The coin identifying device 6 detects an outer diameter and/or magnetic characteristics of the coin fed to determine the coin is whether a designated or an undesignated coin, and transmitts the signal S1 when the coin is determined to be the designated coin or the signal S2 when the coin is determined to be the undesignated coin to the controller 88. The controller 88 stores the signals S1 and S2 in a memory in the order with which the signals S1 and S2 are transmitted, and forms a signal array comprising the signals S1 and S2.

Figure 5D:
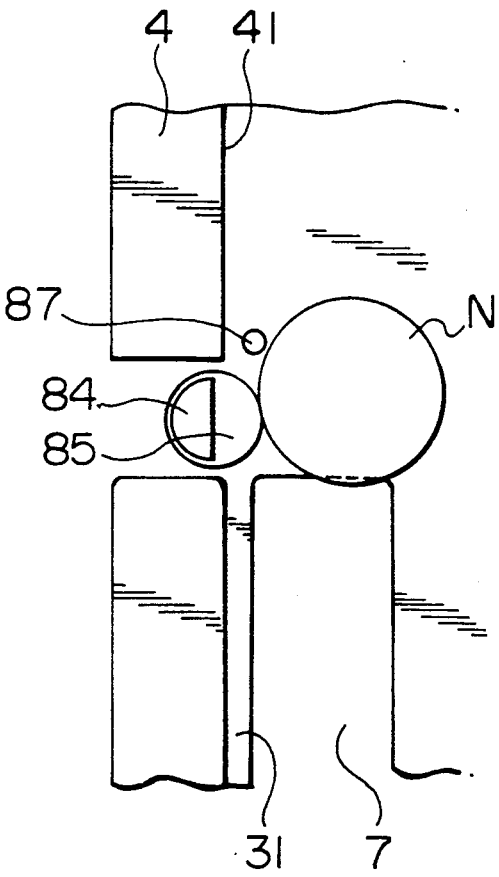

As shown in FIGS. 5A and 5B, each time the coin fed covers the sensor 87, the sensor 87 transmitts a signal S3 to the controller 88. The controller 88 compares the signal array comprising the signals S1 and S2 with the number of the signals S3. When the order of the signal S2 in the signal array accords with the number of the signals S3, the controller 88 drives the rotary solenoid 81 so that the semicircular portion 84 rotates from the first position as shown in FIG. 5A to the second position as shown in FIG. 5B. As shown in FIG. 5C, the undesignated coin N fed collides with the semicircular portion 84 which has been already rotated to the second position and diverges away from the guiding edge 41 as shown by an arrow X2 in FIG. 5C to reach the position shown in FIG. 5D. As aforementioned, since the projection length of the semicircular portion 84 when it is disposed in the second position is determined so that the end N1 of the coin diverged is disposed on the opening 7, the undesignated coin N moves to the position indicated by a broken line in FIG. 5C. After moving, as the undesignated coin N loses the support by the guideway 3, the undesingated coin N cannot continue to be fed by the feeding belt 5. Thus, as shown in FIGS. 6 and 7, the coin N falls into the sort-out opening 7 at the end N1 thereof.

When the undesignated coin N is diverged, the press roller 53 pressing the coin feeding belt 5 against the guideway 3 presses the coin N to assure to avoid the diverged coin N from escaping out of the belt 5.

When the undesignated coin N falls into the sort-out opening 7, the opposite end N2 of the coin N contacts the slant portion 92 of the guide member 9, as shown in FIGS. 6 and 7. Since the undesignated coin N is pressed by the belt 5 even when it falls into the opening 7, the coin N takes a position as shown in FIG. 6, wherein the end N2 springs high above the guideway 3, so that it may take a rather long period to fall into the opening 7. Accordingly, it is necessary to form the opening 7 long. However, in the coin sorting apparatus in accordance with the invention, the guide member 9 is provided to assure that the length of the opening 7 is short enough to fall the coin N into the opening 7 by arranging the slant portion 92 so that the end N2 of the coin N collides with the portion 92 as shown in FIG. 7.

When the undesignated coin N passed over the sensor 87, the sensor 87 tranmitts a signal representing the passage of the coin N over the sensor 87 to the controller 88. On receiving this signal, the controller 88 drives the rotary solenoid 81 to rotate in the counterclockwise direction to return the rotary solenoid 81 to its inactive position shown in FIG. 5D.

The controller 88 compares the signal array comprising the signals S1 and S2 with the number of the signals S3. When the order of the signal S1 in the array accords with the number of the signals S3, the controller 88 does not drive the solenoid 81 to remain the semicircular portion 84 in its inactive position shown in FIG. 5A. Thus, the feeding belt 5 feeds the designated coin R on the guideway 3 to the sort-out opening 7 with a circumferential end of the coin R being kept in contact with the guiding edge 41. As aforementioned, since the length (A+B) measured from the guiding edge 41 to the edge 72 of the opening 7 is smaller than the smallest diameter among coins to be sorted by the coin sorting apparatus 1, the designated coin R is fed without falling into the opening 7, as shown in FIG. 5A, and falls into the coin reservoir 73 disposed downstream of the opening 7.

In such a manner as aforementioned, the designated coins R, which are 100 yen coins in this embodiment, are separated from the undesignated coins N, which are 1 yen, 5 yen, 10 yen, 50 yen and 500 yen coins.

In the aforementioned embodiment of the coin sorting apparatus, many alternatives and modifications can be made as follows.

Figure 8A:
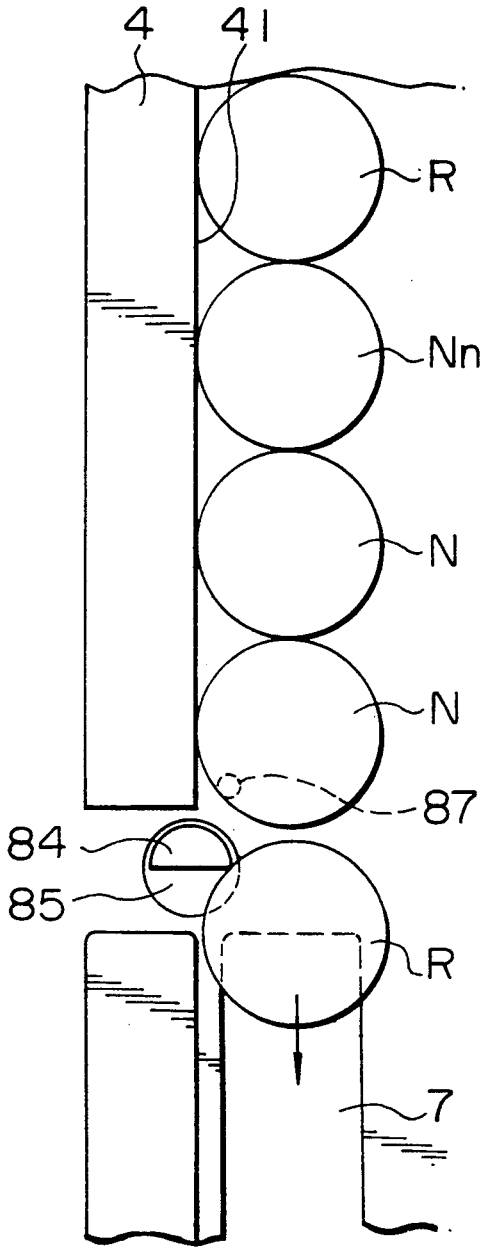
FIGS. 8A and 8B are top plan views illustrating the pivotal movement of the diversion device which occurs when the same kind of coins are continuously fed.
Figure 8B:
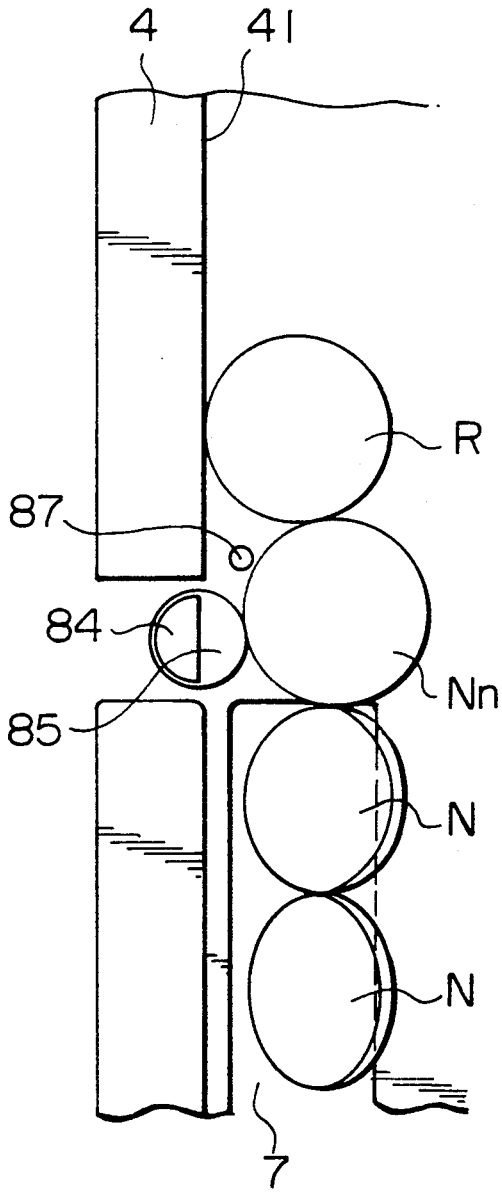

FIGS. 8A and 8B illustrate another way in which the controller 88 drives the rotary solenoid 81 in accordance with the signals S1 and S2 transmitted from the coin identifying device 6. In the aforementioned embodiment, each time the undesignated coin N passes over the sensor 87, the semicircular portion 84 returns from the second position to the first position. In this alternative way, as shown in FIG. 8A, when a plurality of a undesignated coin N are fed continuously, the controller 88 remains the semicircular portion 84 in its second position. The semicircular portion 84 is controlled to return from the second position to the first position after the last undesignated coin N passes over the sensor 87, but before the next designated coin R is fed to the sensor 87, as shown in FIG. 8B. Thus, the number of rotation of the semicircular 84 can be decreased.

Figure 9A:
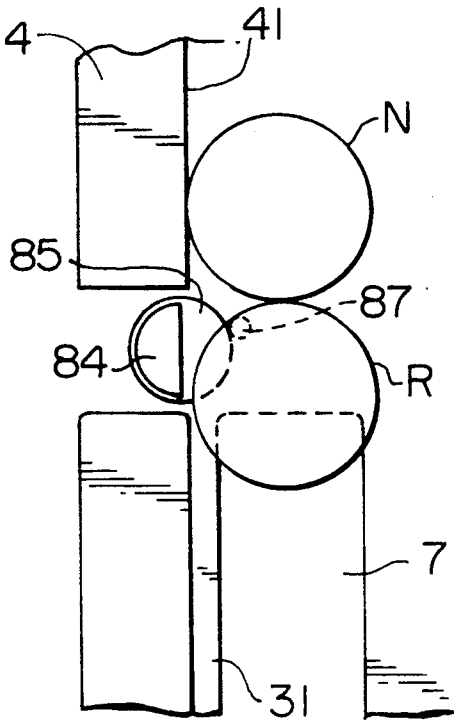
FIGS. 9A to 9C are top plan views of a coin detector positioned differently from FIG. 3.
Figure 9B:
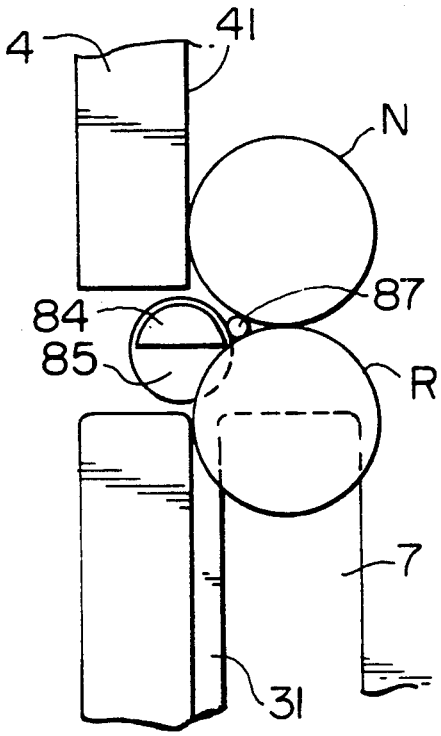
Figure 9C:
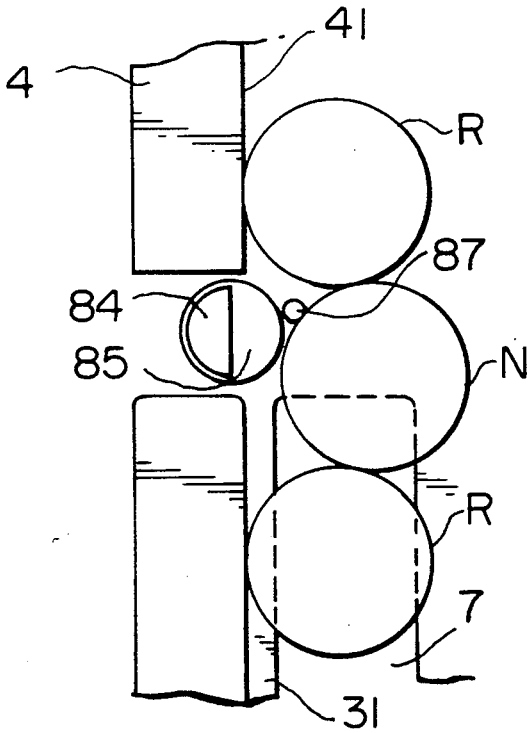

As shown in FIGS. 9A to 9C, the coin detecting sensor 87 can be disposed substantially in front of the semicircular portion 84 while the sensor is disposed upstream of the semicircular 84 in the aforementioned embodiment as shown in FIG. 3. As shown in FIG. 9A, in the case that the undesignated coin N follows the designated coin R, the sensor 87 transmitts a first signal to the controller 88 to drive the solenoid 81 to rotate the semicircular portion 84 from the first position to the second position, as shown in FIG. 9B, when the designated coin R passes over the sensor 87. Then, as shown in FIG. 9C, when the undesignated coin N passes over the sensor 87, the sensor 87 transmitts a second signal to the controller 88 to return the semicircular portion 84 from the second position to the first position. In this embodiment, the semicircular portion 84 may remain in its inactive position when a plurality of the undesignated coin N are continuously fed.

Figure 10:
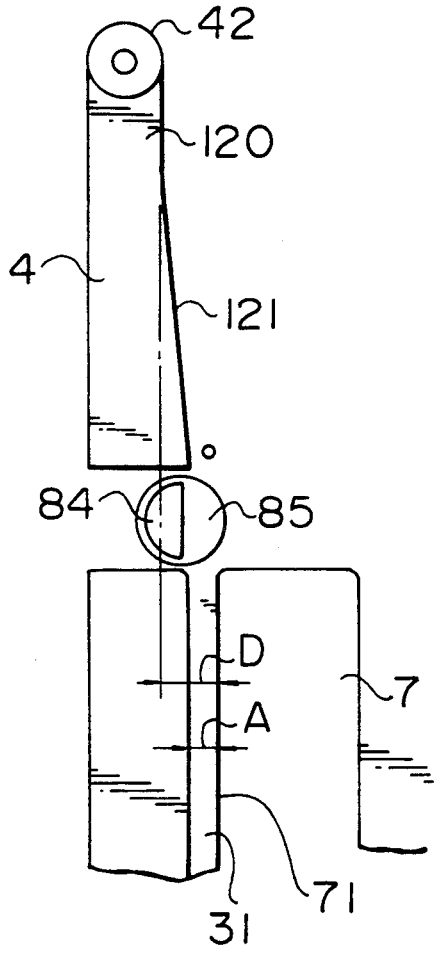
FIG. 10 is a top plan view illustrating another type of guide rail.

FIG. 10 represents a modificated guide rail 4. In this modification, the guide rail 4 includes a straight edge 120 and a taper portion 121 just upstream of the diversion device 8, which taper portion 121 is made to be continuous with the edge 120 and projecting toward the guideway 3 as the taper portion 121 goes downstream in the coin feeding direction.

In order to feed the designated coin R straddling over the sort-out opening 7, it is necessary for the designated coin R to be disposed at any end thereof on the guideway portion 31 which extends between the entrance and the exit of the opening 7. To this end, it is required that any end of the designated coin R is disposed on the extension of the guideway portion 31 between the exit of the rotary disc 21 and the entrance of the opening 7. In this embodiment, the provision of the taper portion 121 assures that the designated coin R can be disposed on the guideway portion 31 when fed to the opening 7 if any end of the designated coin R is disposed within the width D ranging from the straight edge 120 of the guiding edge 41 to the edge 71 of the opening 7 while the coin R is being fed between the exit of the rotary disc 21 and the entrance of the sort-out opening 7. As shown in FIG. 10, since the width D is longer than the width A (D>A), the designated coin R can be easily straddled over the sort-out opening 7.

Figure 11:
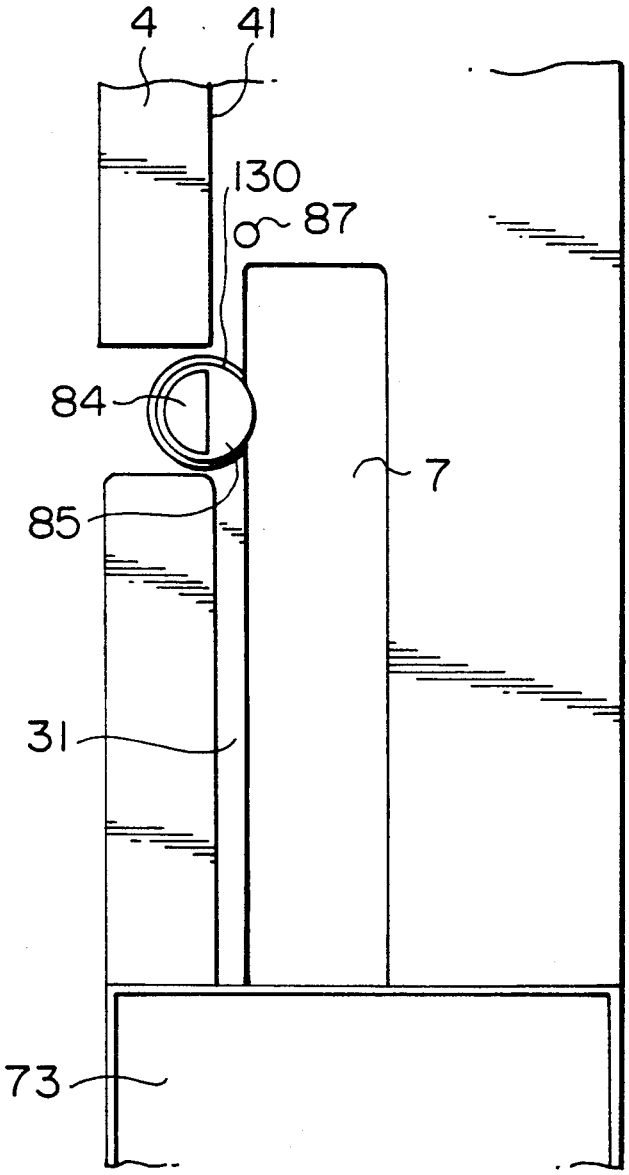
FIG. 11 is a top plan view illustrating a sort-out opening arranged differently from the sort-out opening shown in FIG. 3.

FIG. 11 shows another arrangement of the sort-out opening 7. As shown, the opening 7 may extend from the upstream of the diversion device 8. In this arrangement, the undesignated coin N falls into the opening 7 just when the coin N is diverged by the diversion device 8. However, it should be noted that in this arrangement the guideway portion 31 is divided by the diversion device 8, so that the coins fed tend to stumble on the division line of the guideway portion 31. In order to avoid stumbling of the coins fed, the guideway portion 31 may be formed with a chamfer 130 at least on the upstream side of the diversion device 8.

When the sort-out opening 7 is formed in such an arrangement as shown in FIG. 11, the sensor 87 is to be disposed upstream of the sort-out opening 7. Therefore, since coins being fed take some time to reach the semicircular portion 84 from the sensor 87, the semicircular 84 is arranged to rotate from the first position to the second position when a predetermined period elapsed after the sensor 87 had transmitted the signal S3 to the controller 88.

Figure 12:
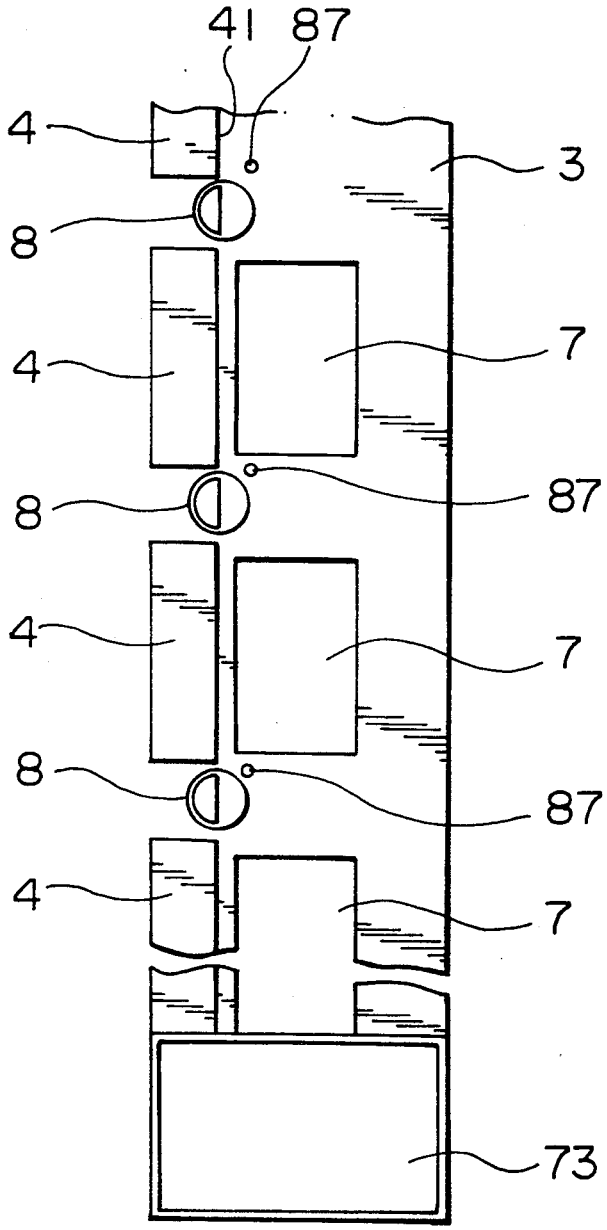
FIG. 12 is a schematic view illustrating a coin sorting apparatus for sorting all kinds of coins, including a plurality of coin sorting units in accordance with the invention.

The coin sorting apparatus 1 in accordance with the invention is applicable to an apparatus for sorting a plurality of coins including all kind of coins into each kind of coin. An example of the apparatus is illustrated in FIG. 12. For instance, in order to sort a plurality of coins including six kinds of coins, which are 1 yen, 5 yen, 10 yen, 50 yen, 100 yen and 500 yen coins, into each kind of coin, six sets of a combination of the diversion device 8, the sort-out opening 7 and the coin detecting sensor 87 are disposed in series along the guideway 3.

Five sets of the combination are sufficient to sort a plurality of coins including six kinds of coins into each kind of coin since the sixth kind of coins are to fall into the reservoir 73. However, the reason for the necessity of the six sets of the combination is that the first set is preferably used to remove foreign and/or counterfeit coins through a sort-out opening thereof. If foreign or counterfeit coins are intended to remove through a sort-out opening of the second set or one of subsequent sets, it causes the incorrect sorting because coins having a diameter smaller than the sum length of the width A and the width B, which may be included in foreign or counterfeit coins, are not able to pass the sort-out opening 7 of the first set. However, it should be noted that it is not always necessary to use a first set for removing foreign or counterfeit coins if coins being fed are able to stop in accordance with the determination made by the coin identifying device 6.

In the second set of the combination, for instance, a 1 yen coin is selected to be an undesignated coin and therefore coins other than 1 yen coins are to be designated coins. Thus, 1 yen coins fall into the opening of the second set and coins other than 1 yen coins pass over the opening. Then, in the third set of the combination, for instance, a 5 yen coin is selected to be an undesignated coin and therefore coins other than 5 yen coins are to be designated coins. In the same way, remaining kind of coins are selected in remaining sets respectively to be an undesignated coin in any order. When coins including six kinds of coins are fed through the six sets of the combination comprising the sort-out opening 7, the diversion device 8 and the coin detecting sensor 87, only one kind of coins remain unsorted and these coins fall into the reservoir 73 having the same opening width as the guideway 3. Thus, a plurality of coins including all kinds of coins are sorted into each kind of coins.

As aforementioned with respect to the preferred embodiment, in accordance with the present invention, it is possible to increase both the accuracy in sorting coins and the coin feeding speed, so that a desired kind of coins can be separated from others more correctly than conventional apparatuses.

While the invention has been described in connection with preferred embodiments, it will be understood that it is not intended to limit the invention to those embodiments. On the contrary, it is intended that the invention cover all alternatives, modifications and equivalents as may be included within the spirit and scope of the invention as defined by the attached claims.

What is claimed is:

1. A coin sorting apparatus comprising:

coin sending out means for receiving a plurality of various kinds of coins and sending out the coins one by one therefrom;

a coin guideway extending from the coin sending out means;

a guide rail having a guiding edge extending in the direction along which the coins are fed and disposed normal to the guideway;

a coin feeding belt for pressing the coins sent out from the coin sending out means against the guideway to feed the coins with a portion thereof kept in contact with the guiding edge;

coin identifying means for grouping the coins fed by the feeding belt into a first and a second group in accordance with the face values of the coins;

separating means having a sort-out opening disposed on the guideway apart from the guiding edge and extending in the coin feeding direction, said means separating the coins into the first and the second groups by dropping the coins belonging to the first group into the sort-out opening and feeding the coins belonging to the second group by the feeding belt, said second group coins straddling over the sort-out opening when being fed, in accordance with the determination by the coin identifying means;

a semicircular member having a planar surface and an arc surface, said semicircular member capable of rotating between a first position wherein said planar surface is disposed substantially in the plane defined by the guiding edge and the arc surface is disposed within the guide rail and a second position wherein said planar surface is disposed normal to the guiding edge and said arc surface faces upstream of the coin feeding direction, said semicircular member rotating from the first position to the second position when the first coin group is fed to collide with said semicircular member so as to diverge the coin away from the guiding edge so that the circumferential end of the coin closest to the guiding edge is disposed on the sort-out opening, said semicircular member returning to the first position when the coin passes the semicircular member;

said sort-out opening being arranged so that the sum length of the length measured from the guiding edge to an edge of the sort-out opening and the width of the sort-out opening is smaller than the smallest diameter among the coins to be sorted by the coin sorting apparatus, the sort-out opening extending from upstream of the semicircular member.

2. A coin sorting apparatus in accordance with claim 1, wherein a sensor for detecting a fed coin is provided on the guideway in the vicinity of the semicircular member to transmit a detection signal to the semicircular member, said semicircular member rotating to the second position when the coin identified as belonging to the first group by the coin identifying means reaches the sensor.

3. A coin sorting apparatus in accordance with claim 1, wherein the sort-out opening extends from the semicircular member toward the downstream of the coin feeding direction.

4. A coin sorting apparatus in accordance with claim 1, wherein said sensor is positioned substantially in front of the semicircular member, said sensor driving the semicircular member to rotate from the first position to the second position when the second group coin passes the sensor in the case where the first group coin is fed after the second group coin.

5. A coin sorting apparatus comprising:

coin sending out means for receiving a plurality of various kinds of coins and sending out the coins one by one therefrom;

a coin guideway extending from the coin sending out means;

a guide rail having a guiding edge extending in the direction along which the coins are fed and disposed normal to the guideway;

a coin feeding belt for pressing the coins sent out from the coin sending out means against the guideway to feed the coins with a portion thereof kept in contact with the guiding edge;

coin identifying means for grouping the coins fed by the feeding belt into a first and a second group in accordance with the face values of the coins;

separating means having a sort-out opening disposed on the guideway apart from the guiding edge and extending in the coin feeding direction, said means separating the coins into the first and the second groups by dropping the coins belonging to the first group into the sort-out opening and feeding the coins belonging to the second group by the feeding belt, said second group coins straddling over the sort-out opening when being fed, in accordance with the determination by the coin identifying means;

a plurality of coin sorting units disposed in series along the coin feeding direction, each said coin sorting unit including a semicircular member having a planar surface and an arc surface, said semicircular member being capable of rotating between a first position wherein said planar surface is disposed substantially in the plane defined by the guiding edge and the arc surface is disposed within the guide rail and a second position wherein said planar surface is disposed normal to the guiding edge and said arc surface faces upstream of the coin feeding direction, said semicircular member rotating from the first position to the second position when the first coin group is fed to collide with said semicircular member so as to diverge the coin away from the guiding edge so that the circumferential end of the coin closest to the guiding edge is disposed on the sort-out opening, said semicircular member returning to the first position when the coin passes the semicircular member;

said sort-out opening being arranged so that the sum length of the length measured from the guiding edge to an edge of the sort-out opening and the width of the sort-out opening is smaller than the smallest diameter among the coins to be sorted by the coin sorting apparatus, the sort-out opening extending from upstream of the semicircular member.

6. A coin sorting apparatus in accordance with claim 5, wherein the number of the coin sorting units is smaller by one than the number of the kinds of coins to be sorted by the coin sorting apparatus.

7. A coin sorting apparatus in accordance with claim 5, wherein the number of the coin sorting units is equal to the number of the kinds of coins to be sorted by the coin sorting apparatus and the first coin sorting unit is arranged to remove foreign and/or counterfeit coins.

8. A coin sorting apparatus in accordance with claim 5, wherein a sensor for detecting a fed coin is provided on the guideway in the vicinity of the semicircular member to transmit a detection signal to the semicircular member, said semicircular member rotating to the second position when the coin identified as belonging to the first group by the coin identifying means reaches the sensor.

9. A coin sorting apparatus in accordance with claim 5, wherein the sort-out opening extends from the semicircular member toward the downstream of the coin feeding direction.

10. A coin sorting apparatus in accordance with claim 8, wherein said sensor is positioned substantially in front of the semicircular member, said sensor driving the semicircular member to rotate from the first position to the second position when the second group coin passes the sensor in the case where the first group coin is fed after the second group coin.

11. A coin sorting apparatus comprising:

coin sending out means for receiving a plurality of various kinds of coins and sending out the coins one by one therefrom;

a coin guideway extending from the coin sending out means;

a guide rail having a guiding edge extending in the direction along which the coins are fed and disposed normal to the guideway;

a coin feeding belt for pressing the coins sent out from the coin sending out means against the guideway to feed the coins with a portion thereof kept in contact with the guiding edge;

coin identifying means for grouping the coins fed by the feeding belt into a first and a second group in accordance with the face values of the coins;

separating means having a sort-out opening disposed on the guideway apart from the guiding edge and extending in the coin feeding direction, said means separating the coins into the first and the second groups by dropping the coins belonging to the first group into the sort-out opening and feeding the coins belonging to the second group by the feeding belt, said second group coins straddling over the sort-out opening when being fed, in accordance with the determination by the coin identifying means;

a semicircular member having a planar surface and an arc surface, said semicircular member capable of rotating between a first portion wherein said planar surface is disposed substantially in the plane defined by the guiding edge and the arc surface is disposed within the guide rail and a second position wherein said planar surface is disposed normal to the guiding edge and said arc surface faces upstream of the coin feeding direction, said semicircular member rotating from the first position to the second position when the first coin group is fed to collide with said semicircular member so as to diverge the coin away from the guiding edge so that the circumferential end of the coin closest to the guiding edge is disposed on the sort-out opening, said semicircular member returning to the first position when the coin passes the semicircular member;

said sort-out opening being arranged so that the sum length of the length measured from the guiding edge to an edge of the sort-out opening and the width of the sort-out opening is smaller than the smallest diameter among the coins to be sorted by the coin sorting apparatus, the guiding edge having a tapered portion disposed upstream of and adjacent to the semicircular member, said tapered portion projecting toward the guideway.

12. A coin sorting apparatus comprising:

coin sending out means for receiving a plurality of various kinds of coins and sending out the coins one by one therefrom;

a coin guideway extending from the coin sending out means;

a guide rail having a guiding edge extending in the direction along which the coins are fed and disposed normal to the guideway;

a coin feeding belt for pressing the coins sent out from the coin sending means against the guideway to feed the coins with a portion thereof kept in contact with the guiding edge;

coin identifying means for grouping the coins fed by the feeding belt into a first and a second group in accordance with the face values of the coins;

separating means having a sort-out opening disposed on the guideway apart from the guiding edge and extending in the coin feeding direction, said means separating the coins into the first and the second groups by dropping the coins belonging to the first group into the sort-out opening and feeding the coins belonging to the second group by the feeding belt, said second group coins straddling over the sort-out opening when being fed, in accordance with the determination by the coin identifying means;

a plurality of coin sorting units disposed in series along the coin feeding direction, each said coin sorting unit including a semicircular member having a planar surface and an arc surface, said semicircular member being capable of rotating between a first position wherein said planar surface is disposed substantially in the plane defined by the guiding edge and the arc surface is disposed within the guide rail and a second position wherein said planar surface is disposed normal to the guiding edge and said arc surface faces upstream of the coin feeding direction, said semicircular member rotating from the first position to the second position when the first coin group is fed to collide with said semicircular member so as to diverge the coin away from the guiding edge so that the circumferential end of the coin closest to the guiding edge is disposed on the sort-out opening, said semicircular member returning to the first position when the coin passes the semicircular member;

said sort-out opening being arranged so that the sum length of the length measured from the guiding edge to an edge of the sort-out opening and the width of the sort-out opening is smaller than the smallest diameter among the coins to be sorted by the coin sorting apparatus, the guiding edge having a tapered portion disposed upstream of and adjacent to the semicircular member, said tapered portion projecting toward the guideway.

* * * * *